US006678493B2

(12) United States Patent
Maeyama et al.

(10) Patent No.: US 6,678,493 B2
(45) Date of Patent: Jan. 13, 2004

(54) IMAGE FORMING APPARATUS AND INTERMEDIATE TRANSFER BELT MODULE TO EFFICIENTLY ACCOMMODATE ADDITIONAL IMAGE FORMING UNIT

(75) Inventors: Ryuichiro Maeyama, Ashigarakami-gun (JP); Yoshikazu Okamoto, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 10/097,410

(22) Filed: Mar. 15, 2002

(65) Prior Publication Data

US 2003/0099492 A1 May 29, 2003

(30) Foreign Application Priority Data

Nov. 29, 2001 (JP) ..... 2001-364434

(51) Int. Cl.[7] ..... G03G 15/01

(52) U.S. Cl. ..... 399/302; 347/3; 399/2; 399/223; 399/341

(58) Field of Search ..... 399/302, 308, 399/223, 341, 342, 299, 2, 107, 121, 162, 165; 347/1–4, 103, 115, 153, 151; 430/126, 42, 47, 97

(56) References Cited

U.S. PATENT DOCUMENTS 5,147,745 A * 9/1992 Russel ..... 430/126
6,381,428 B1 * 4/2002 Yamamoto et al. ..... 347/115
6,389,246 B1 * 5/2002 Nakamura et al. ..... 399/66
6,389,260 B1 * 5/2002 Kataoka et al. ..... 399/302

FOREIGN PATENT DOCUMENTS

JP 4-345179 A * 12/1992
JP 8-185006 A * 7/1996
JP A 10-301402 11/1998
JP A 2000-347476 12/2000

* cited by examiner

*Primary Examiner*—Joan Pendegrass
(74) *Attorney, Agent, or Firm*—Oliff & Berridge, PLC

(57) ABSTRACT

The specification discloses an image forming apparatus which forms a visual image on a belt transfer member by at least one of image forming units and transfers the formed visual image onto a recording medium with the aid of the belt transfer member. In the image forming apparatus, the belt transfer member includes an endless belt wound on a plurality of tension rolls. A bending member, which bends the endless belt toward the inside of a tangential line connecting points on the outer circumferences of a couple of tension rolls, and locates the bent endless belt inside the tangential line, is additionally provided outside the endless belt located between at least the couple of adjacent tension rolls. An image forming unit may be additionally provided within an outside bending concave region of the endless belt, which is bent by the bending member and the tension rolls adjacent to the bending member.

21 Claims, 13 Drawing Sheets

IMAGE FORMING APPARATUS AND INTERMEDIATE TRANSFER BELT MODULE TO EFFICIENTLY ACCOMMODATE ADDITIONAL IMAGE FORMING UNIT

BACKGROUND OF THE INVENTION

1. Field of the Invention

The present invention relates to an image forming apparatus, such as a copying machine, a printer and a facsimile machine. More particularly, the invention relates to an image forming apparatus of the type which uses a belt transfer member when an image is transferred onto a recording medium, and improvement of a belt module for use with the image forming apparatus.

2. Description of the Related Art

An intermediate transfer type image forming apparatus maybe exemplified for this type of the image forming apparatus. In the image forming apparatus, a toner image is formed by an image forming unit based on the electrophotography, is primarily transferred onto the intermediate transfer member, and the toner image is secondarily transferred from the intermediate transfer member onto a recording medium.

In this type of the image forming apparatus, to form a color image, color component toner images are primarily transferred onto the intermediate transfer member in successive manner to superimpose those component color toner images. In the primary image transferring process, the images are transferred onto the intermediate transfer member in good conditions. As a result, a good color image suffering from less color misregistration is obtained.

An endless intermediate transfer belt or a cylindrical intermediate transfer drum is generally used for the intermediate transfer member. In most cases, the intermediate transfer belt is used since the respective devices within the image forming apparatus may be laid out at high freedom.

The following proposals are present for the purpose of improving a color image quality. A first proposal is that developing devices containing six color component toners are mounted on a rotary developing unit, thereby improving the color reproducibility of a reproduced image (e.g., JP-A-Hei.10-301402). A second proposal is that with an intention of reproducing a glossy image, a plurality of image forming units using basic four colors, cyan, yellow, magenta, and black, are disposed around the intermediate transfer belt, and an image forming unit using a transparent, clear toner is additionally provided therearound (e.g., JP-A-2000-347476).

In the conventional intermediate transfer type image forming apparatus, the rotary developing unit is size increased by an amount corresponding to the increased number of developing devices. Further, the number of image forming units disposed around the intermediate transfer belt is increased, so that the image forming apparatus is size increased as a whole.

Those technical problems arises not only in the image forming apparatus having the intermediate transfer belt but also in the image forming apparatus having an image bearing belt for supporting images thereon and transporting them.

Accordingly, an object of the present invention is to provide an image forming apparatus which makes more improvement of the color reproducibility of a reproduced image while effectively suppressing the size increase of the whole image forming apparatus, and a belt module for use with the image forming apparatus.

SUMMARY OF THE INVENTION

In the image forming apparatus having a belt transfer member such as an intermediate transfer belt, the belt transfer member is generally constructed such that an endless belt is wound on tension rolls. Accordingly, an area occupied by the belt transfer member is determined by the positions of the tension rolls. Therefore, it is possible to secure a space in which the image forming unit is installed by narrowing the space occupied by the belt transfer member. The inventors of the present invention directed their attention to this point, and reached the technical idea of the present invention.

In the following description, reference numerals are added to constituent elements to facilitate understanding the invention. However, the reference numerals do not limit the invention to the following description.

As shown in FIG. 1, according to the invention, there is provided an image forming apparatus having at least one image forming unit 1 (for example 1*a* to 1*d*), a belt transferring member 2, a plurality of tension rolls 3 (for example 3*a* to 3*c*), and a bending member 5, in which the image forming unit 1 forms a visual image on the belt transferring member 2 to transfer the visual image onto a recording medium 8 through the belt transferring member 2, the belt transferring member 2 has an endless belt 4 wound on the tension rolls 3, the bending member 5 is disposed in outside of the endless belt 4 between at least a pair of tension rolls 3 (for example 3*b* and 3*c*) to bend the endless belt 4 toward inside of a tangential line m connected between an outer peripheral ends of at least the pair of adjacent tension rolls 3, the tangential line m and the endless belt 4 define an outer bending concave region 6, and it is possible to dispose an additional image forming unit 7 in the outer bending concave region 6.

In the technique thus constructed, the image forming units 1 may be not only of the electrophotography type and electrostatic recording type, but also of the ink jet type, the magnetrophy type, the elcography type, the offset printing, the gravure printing, and the thermal-transfer printing.

The wording "at least one image forming units 1" is used to imply that the image forming apparatus involves a plural-cycle machine with one image forming unit 1 as well as a tandem machine with a plurality of image forming units 1.

If the image forming unit 1 is based on the electrophotography process, the belt transfer member 2 means mainly the intermediate transfer member. If the image forming unit is of the ink jet type, the belt transfer member 2 involves a visual image transport/transfer member which carries the image thereon and transports the image, and transfers the image on a recording medium.

The bending member 5 may appropriately be selected so long as the bending member 5 bends the endless belt 4 toward the inside of a tangential line "m" connecting points on the outer circumferences of a couple of tension rolls 3 (e.g., 3*b*, 3*c*), and locates the bent endless belt 4 inside the tangential line, is additionally provided outside the endless belt 4 located between at least the couple of adjacent tension rolls 3 (e.g., 3*b*, 3*c*). In this case, care must be taken so as not to impair the transportation of the belt transfer member 2, and a disturbance of the visual image.

The endless belt 4 is bent by the bending member 5 and the tension rolls 3 (e.g., 3*b*, 3*c*) adjacent to the bending member. The outside bending concave region 6 is secured between the bent part of the endless belt 4 and the tangential line "m".

The outside bending concave region 6 is not specifically limited so far as to allow the image forming unit 7 to additionally be installed therein. In this case, it is not essential whether or not the image forming unit 7 is additionally installed.

To improve the color reproducibility of the reproduced image, the image forming unit 7 is additionally provided within the outside bending concave region 6.

By so doing, even if the image forming unit 7 is additionally provided within the outside bending concave region 6 of the endless belt 4, there is no increase of the apparatus size.

Here, it is essential that the image forming unit 7 is merely installed at the outside bending concave region 6, and it is not essential that it is located completely within the outside bending concave region 6.

In the image forming apparatus of the invention, it is not always needed that the image forming unit 7 is additionally installed. If such a space as to allow the additional installation of the image forming unit is provided, the image forming unit may be additionally installed as an option as desired.

Wit regard to the layout of the bending member 5, the bending member 5 is in contact with the surface of the belt transfer member 2. Therefore, to prevent a disturbance of a visible image on the belt transfer member 2, it is preferable to locate the bending member 5 at a location where the visible image on the belt transfer member 2 is not nipped. To increase a layout freedom of the bending member, it is preferable to locate the bending member 5 at a location where the visible image carried on the belt transfer member 2 is nipped and to design to prevent the disturbance of the visible image.

A preferable specific form of the bending member 5 is a rotary body in order to minimize a contact resistance between the bending member 5 and the belt transfer member 2.

To effectively avoid such a situation that the charged particles forming a visible image or a residual visible image on the belt transfer member 2, attach to the bending member 5, it is preferable that a transfer blocking bias voltage for preventing the transferring mainly of the visual image or the residual visual image on the belt transfer member 2, is applied to the bending member 5.

The transfer blocking bias voltage varies depending on the layout of the bending member 5. Where the bending member 5 is located at a position where the visual image on the belt transfer member 2 passes, a bias voltage the polarity of which is the same as of the charged particles forming the visible image is applied to the bending member, thereby preventing he charged particles from attaching to the bending member 5. Where the bending member 5 is located at a position where the residual visible image on the belt transfer member 2 passes, a bias voltage the polarity of which is the same as of the charged particles forming the residual visible image is applied to the bending member, thereby preventing the charged particles from attaching to the bending member 5.

In this type of transfer blocking bias voltage, to make the transfer blocking effect more reliable, it is preferable to apply an AC bias voltage to the transfer blocking bias voltage at a predetermined duty ratio.

To effectively avoid such a situation that the charged particles forming a visible image or a residual visible image on the belt transfer member 2 attach to the bending member 5, it is preferable that the bending member 5 is electrically earthed, thereby suppressing the charge accumulation on the bending member 5.

In case that the surface property is used for the approach to prevent the visible image or the like from attaching to the bending member 5, the bending member may have a surface protective layer for preventing transferring mainly of at least one of the visual image and a residual visual image on the belt transfer member 2 to the bending member 5.

To make an easy control of the surface potential of the bending member 5, the bending member is preferably a photoreceptor including a surface having a photoconductive and photosensitive layer.

In the embodiment, another device may be used for the charging; however, it is preferable to use natural charging by friction charging for the charging.

Taking easy maintenance into account, it is preferable that the bending member 5 is detachable from the belt transfer member 2.

Further, in the invention, the bending member 5 may be used serving as another functional member. In a preferred embodiment, the bending member 5 serves as a steering member for controlling a meandering motion of the belt transfer member 2.

All those image forming units 1, 7 including the additional image forming unit 7 may be based on the same image forming process (e.g., electrophotography process). Of the image forming processes employed, at least one image forming process (e.g., the combination of the electrophotography process and the ink jet image forming process) may be different from the remaining image forming processes.

For the image forming method for forming a gloss image as the image forming units 1 and 7, it suffices that at least one of the image forming units 1 and 7 forms a gloss transparent layer.

In this case, the gloss transparent layer enhances the surface smoothness, increases the amount of reflecting light, and reduces the amount of scattering light.

In a case where the non-gloss transparent layer is additionally used, it is satisfactory that at least one of the image forming units 1 and 7 forms a non-gloss transparent layer (using transparent particles of 15 $\mu$m or larger in particle diameter, and its surface is made coarse or the transparent particles are put therebetween, so that the surface is made coarse.).

For another image forming method for forming the gloss image, at least one of the image forming units 1 and 7 selects one of a glossy colorant and a non-glossy colorant in relation to at least one color component.

In another image forming method by using the image forming units 1 and 7, at least one of the additional image forming unit and the image forming units forms a transparent layer to laminate the transparent layer corresponding to a surface of the recording medium and the remaining image forming units use ink colorant to be impregnated into the transparent layer.

This embodiment is preferable in that a thickness of the colorant is reduced and the fixing property is improved.

An additional image forming method by using the image forming units 1 and 7, is not only an Amplitude Modulation method in which the color component images are layered one on another, but also an Frequency Modulation method in which the color component images are arrayed side by side. If required, both the Amplitude Modulation and the Frequency Modulation may be employed for one image formation.

In a typical embodiment based on the Frequency Modulation, the plurality of image forming units 1 or 7 have color component colorants for forming color images and wherein the image forming units arrange the color component colorants in non-superimposing fashion.

A unit pixel of the color component image by each color component colorant is preferably set to be as small as possible, e.g., 20 $\mu$m or less.

Where such an Frequency Modulation is employed, there is no need of using the screen, and hence, generation of moire is prevented. Further, colorant is less wasted.

The invention is not limited the image forming apparatus. Taking account of the possibility that the belt module in which the belt transfer member 2 is bent and disposed is separately marketed, according to the invention, there is also provided a belt module having at least one image forming unit for forming a visual image on the belt transferring member, a belt transferring member, a plurality of tension rolls, and a bending member, in which the belt transferring member has an endless belt wound on the tension rolls, the bending member is disposed in outside of the endless belt between at least a pair of tension rolls to bend the endless belt toward inside of a tangential line connected between an outer peripheral ends of at least the pair of adjacent tension rolls, the tangential line and the endless belt define an outer bending concave region, and the image forming unit is disposed in the outer bending concave region. That is, the present invention is also applicable to a belt module which is provided with the above-mentioned belt transfer member 2 (the outside bending concave region 6 defined by the bending member 5), in addition to the image forming apparatus.

According to the invention, there is also provided an image forming apparatus having an image forming unit for forming a full color image and a transfer member for successively transferring the image formed by the image forming unit, in which a glossy image forming unit is disposed on a side where the glossy image forming unit is opposed to the image forming unit through the image forming unit.

According to the invention, there is also provided an image forming apparatus having an image forming unit for forming a full color image and a transfer member for successively transferring the image by the image forming unit, in which a glossy image forming unit is disposed in a downstream of the image forming unit.

According to the invention, there is also provided the image forming apparatus as above described in which the image forming unit for forming the full color image is capable of forming color images of Y, M and C colors.

According to the invention, there is also provided the image forming apparatus as above described, wherein the additional image forming unit and the image forming units include an ink jet image forming unit.

BRIEF DESCRIPTION OF THE PREFERRED EMBODIMENTS

DETAILED DESCRIPTION OF THE PREFERRED EMBODIMENTS

The preferred embodiments of the present invention will be described with reference to the accompanying drawings.

<Embodiment 1>

Figure 1:
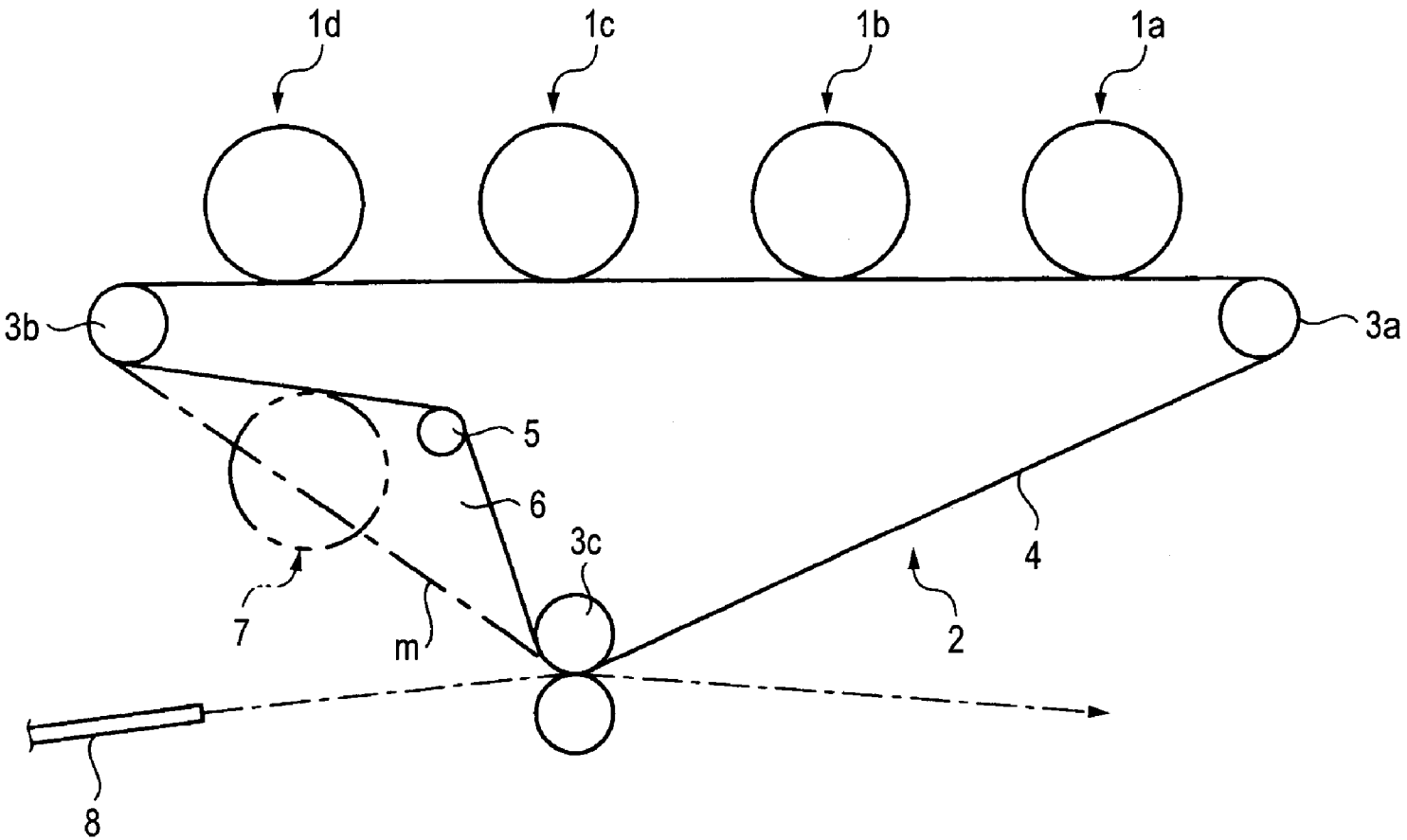
FIG. 1 is a diagram showing an outline of an image forming apparatus incorporating the present invention thereinto.
Figure 2:
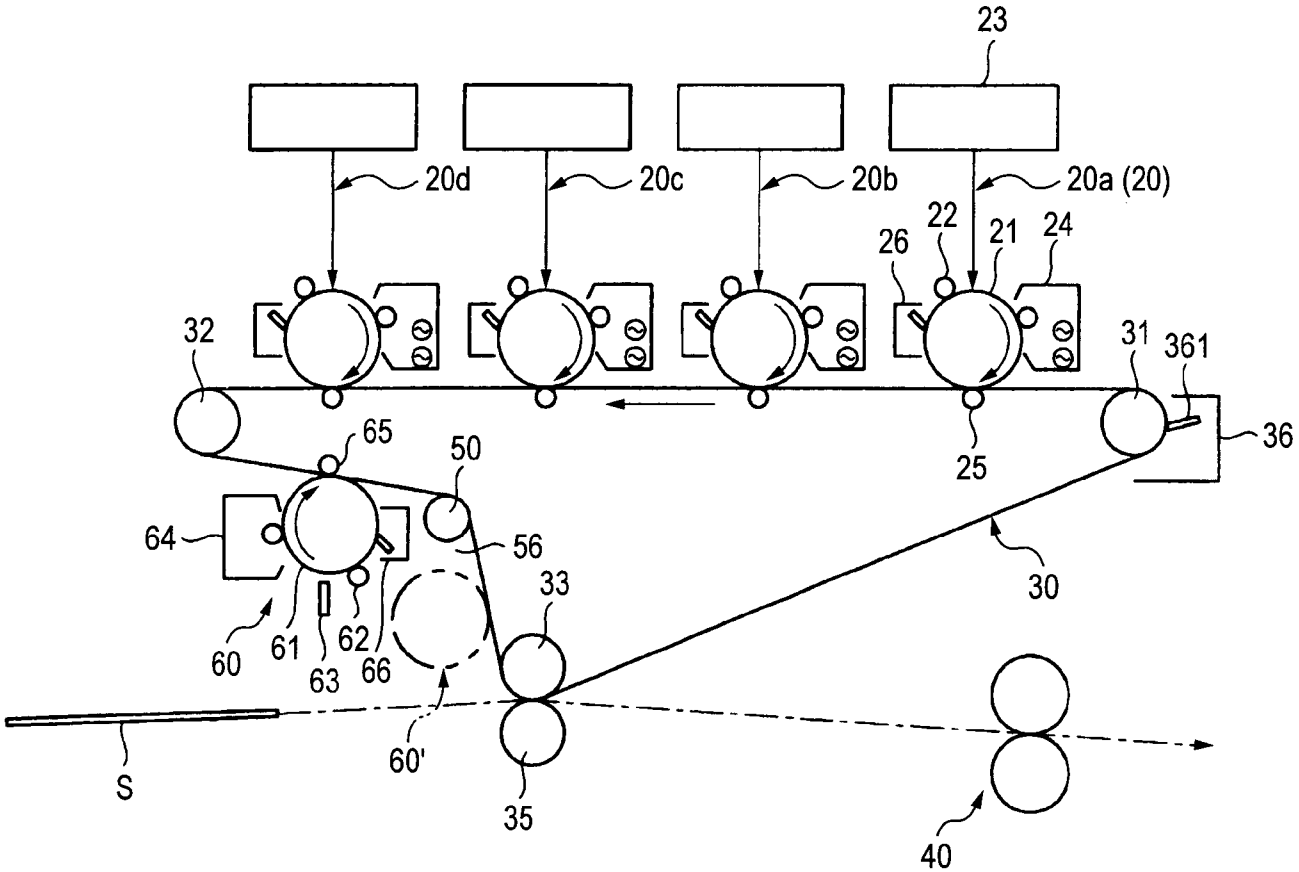
FIG. 2 is a diagram showing an embodiment 1 of an image forming apparatus incorporating the present invention thereinto.

FIG. 2 is a diagram showing an embodiment 1 of an image forming apparatus of an intermediate transfer type, which incorporates the present invention thereinto.

In the figure, the image forming apparatus of the intermediate transfer type contains four normal image forming units 20 (20*a* to 20*d*), which are arranged side by side, which respectively form a plurality of color component images (of colors of magenta (M), cyan (C), yellow (Y), black (K) in this embodiment). An intermediate transfer belt 30 is disposed under those image forming units 20. The color component images formed by the image forming units 20 are transferred onto a recording sheet S with the aid of the intermediate transfer belt 30. Then, the image, not yet fixed, on the recording sheet S is fused and fixed by a fixing unit 40.

In the embodiment, each normal image forming unit 20 includes a photoreceptor drum 21, which is rotated in a predetermined direction. Arranged around the photoreceptor drum 21 are a charging unit 22, an exposure unit 23, a developing unit 24, a primary transfer unit 25, and a cleaning unit 26. The charging unit 22 charges the photoreceptor drum 21. The exposure unit 23 writes an electrostatic latent image onto the charged photoreceptor drum 21. The developing unit 24 develops the electrostatic latent image on the photoreceptor drum 21 by using corresponding color component toners. The primary transfer unit 25 primarily transfers color component toner images on the photoreceptor drum 21 onto the intermediate transfer belt 30. The cleaning unit 26 removes, for cleaning, residual toner on the photoreceptor drum 21.

The photoreceptor drum 21 is constructed such that a photosensitive layer is formed on the surface of a cylindrical body, electrically earthed.

Examples of materials, which may be used for the photosensitive layer, are organic photosensitive material, amorphous selenium photosensitive material, and amorphous silicon photosensitive material.

The charging unit 22 is a charging roll constructed such that a conductive metallic roll, such as stainless steel or aluminum, is coated with a material having high resistance. The charging unit 22 is brought into contact with the photoreceptor drum 21 and follows the latter in rotation. A predetermined voltage is applied to the charging unit, and under the voltage, an electric discharge continuously occurs in a minute gap near a contacting part between the charging unit 22 and photoreceptor drum 21, and with the discharging, the surface of the photoreceptor drum 21 is substantially uniformly charged. The exposure unit 23 consists of a laser scanning device or the like which irradiates laser light on the surface of the photoreceptor drum in accordance with image signals, and moves the laser light in the main scan direction of the photoreceptor drum 21 by use of a polygon mirror. Through the radiation and scanning operation, the exposure unit 23 forms an electrostatic latent image on the surface of the photoreceptor drum 21.

Further, the developing unit 24 supplies color toners such as Magenta, Cyan, Yellow, Black, Green, Orange, and the like of the component colors to the electrostatic latent image, thereby developing the latent image into visible images. The two-component developing system or the one-component developing system may be selectively used as desired.

The primary transfer unit 25 is constructed with a primary transfer roll which is located on the reverse side of the intermediate transfer belt 30, for example, while being in contact with the latter. The primary transfer roll is applied with a predetermined primary transfer bias voltage. There is another construction of the primary transfer unit in which a conductive layer is located within the intermediate transfer belt 30, and a predetermined primary transfer voltage is applied to this conductive layer.

The 0-volt transfer may be carried out if the following conditions are set up: a developing part on the surface potential of the photoreceptor drum 21 in a primary transfer area is set at −450 V, and a non-developing part is set at −810 V, the intermediate transfer belt 30 is set at ±0 V, the charge amount of the charged toner is set at 30 $\mu$C/g, and a metallic roll is used for a bending roll 50 to be described later.

A blade cleaning method in which a blade is brought into contact with the photoreceptor drum 21, for example, may be employed for the cleaning unit 26. If required, a brush cleaning method or any other cleaning method may be employed instead.

The intermediate transfer belt 30 is wound around three tension rolls 31 to 33 in a circulating fashion.

In the embodiment, the intermediate transfer belt 30 is, for example, a polyimide belt of a predetermined thickness. The tension roll 31 serves as a drive roll, and the tension rolls 32 and 33 serve as follower rolls.

A secondary transfer roll as a secondary transfer unit 35 is pressed against the surface of the intermediate transfer belt 30 at a position corresponding to the tension roll 33. In the secondary transfer unit 35, the tension roll 33 is used as a back-up roll, and one of them is applied with a predetermined secondary transfer bias voltage, while the other is earthed.

A belt cleaning unit 36 is provided at a position corresponding to the tension roll 31 in association with the intermediate transfer belt 30.

In the belt cleaning unit 36, the tension roll 31 functions as a back-up roll, and a blade 361 is used in contact with the intermediate transfer belt 30.

In particular in this embodiment, a rotatable bending roll 50 is disposed outside and in contact with the intermediate transfer belt 30, which is disposed between a pair of the adjacent tension rolls 31 and 32. The bending roll 50 bends the intermediate transfer belt 30 toward the inside of a tangential line connecting points on the outer circumferences of the pair of tension rolls 32 and 33.

Accordingly, in the embodiment, an outside bending concave region 56 is formed outside of the intermediate transfer belt 30, which is bent by the bending roll 50 and the tension rolls 32 and 33 adjacent to the bending roll 50. Within the outside bending concave region 56, a gloss image forming unit 60 is additionally provided between the tension roll 32 and the bending roll 50.

In the embodiment, the intermediate transfer belt 30 and a belt frame (not shown) are both modularized. The bending roll 50 and the like are detachably mounted to secure an easy maintenance.

Figure 3A:
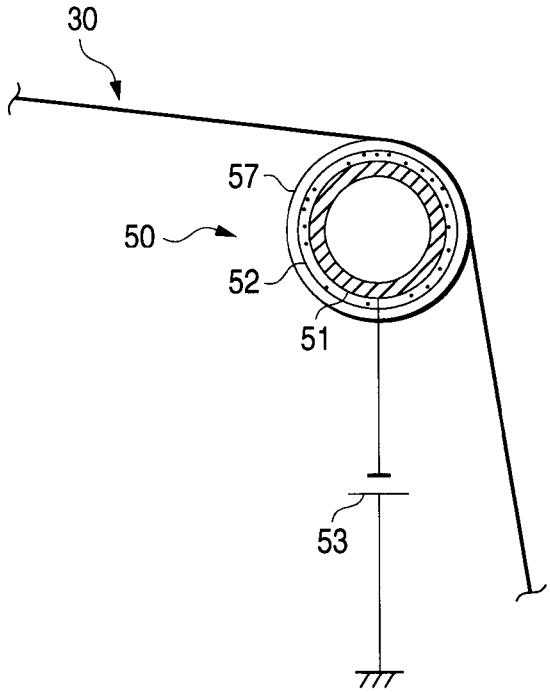
FIG. 3A is a diagram for explaining an arrangement of a bending roll used in the embodiment 1.

In the embodiment, the bending roll 50 is constructed such that a photosensitive layer 52 is formed over the surface of a metallic roll body 51, and the surface of the resultant is covered with a protective layer 57, as shown in FIG. 3A.

The protective layer 57 prevents a chemical change of a charge transport layer of the photosensitive layer 52 having a laminated structure when it is charged, and improves a mechanical strength of the photosensitive layer 52.

The protective layer 57 is formed by adding a conductive material into an appropriate structural resin.

In this instance, examples of materials which may be used for the conductive material are metallocene compounds such as N,N'-dimethylferrocene, aromatic amine compounds such as N,N'-diphenyl-N,N'-bis(3-methylphenyl)-[1,1'-biphenyl]-4,4'-diamine, and metal oxides such as antimony oxide; tin oxide; titanium oxide; indium oxide; and tin oxide—antimony oxide. Examples of structural resins, which may be used for the protective layer 57, are the following known resins: polyamide resin, polyurethane resin, polyester resin, epoxy resin, polyketone resin, polycarbonate resin, polyvinylketone resin, polystyrene resin, and polyacrylamide resin.

In the embodiment, as shown in FIG. 3A, a bias voltage supply 53 is connected to the roll body 51 of the bending roll 50. The bias voltage supply applies to the roll body a bias voltage, which has the same polarity (e.g., negative polarity in this instance) as that of the color component toners, for the purpose of blocking the transferring of toners.

In a case where the bending roll 50 including the photosensitive layer 52 is used in the embodiment, a predetermined bias voltage for blocking the toner transferring may be applied in a manner that the surface potential of the bending roll 50 as friction charged is controlled by using a light beam emitted by an LED array 54.

Figure 3B:
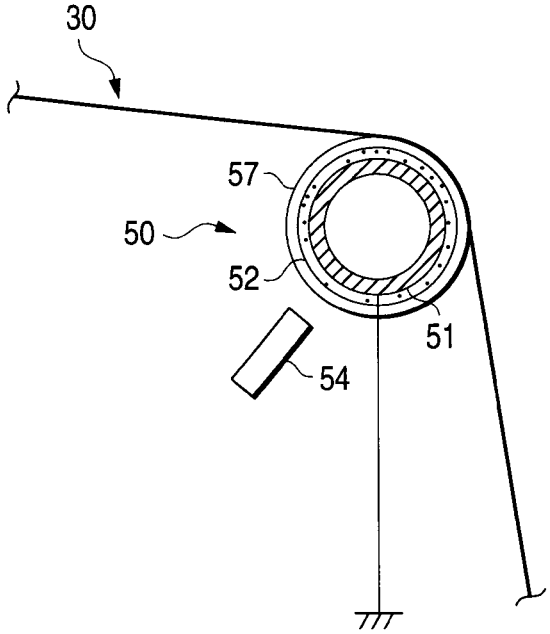
FIG. 3B is a diagram for explaining another arrangement of the bending roll.

In an embodiment shown in FIG. 3B, there is no fear that charge is needlessly accumulated in the surface of the bending roll 50 since the roll body 51 of the bending roll 50 is earthed.

In the above embodiments and embodiments to follow, the bending roll 50 was used and will be used. If required, it may be substituted by a conductive brush or another suitable means. The bending member may be a belt whose inner surface is supported by rolls, which is brought into contact with the intermediate transfer belt. In this case, the life time of the protective layer 57 is extended by a time length corresponding to the peripheral length of the belt.

In the embodiment, the gloss image forming unit 60 includes a photoreceptor drum 61, which is rotated in a predetermined direction. Disposed around the photoreceptor drum 61 are a charging unit (in this instance, charging roll) 62, an exposure unit (in this instance, LED array) 63, a gloss developing unit 64, a primary transfer unit (in this instance, primary transfer roll) 65, and a cleaning unit 66. The charging unit 62 charges the photoreceptor drum 61. The exposure unit 63 forms an electrostatic latent image for specifying a gloss image area on the charged photoreceptor drum 61 (The gloss image area is the entire area of the surface of a recording sheet R, an area corresponding to a part of the recording sheet surface, an area of the surface where the color component toners are not present, or the like). The gloss developing unit 64 develops the electrostatic latent image formed on the photoreceptor drum 61 into a gloss transparent toner image by using gloss transparent toner. The primary transfer unit 65 transfers the gloss transparent toner image that is formed on the photoreceptor drum 61, onto the intermediate transfer belt 30. The cleaning unit 66 removes gloss transparent toner left on the photoreceptor drum 61, for cleaning.

The gloss transparent toner (called clear toner) may be a charging adjusted, transparent resin of about 15 $\mu$m thick, made of polyester, styrene-acryl, or COC (cyclic olefin: see JP-A-Hei.5-97933, JP-A-Hei.5-230147, and JP-A-Hei.6-348058).

The gloss image forming unit 60 is operated when a gloss mode is selected by a select button (not shown). When the gloss mode is not selected, the gloss image forming unit 60 is put in a non-operation state.

Operations of the image forming apparatus of the embodiment will be described.

Figure 4A:
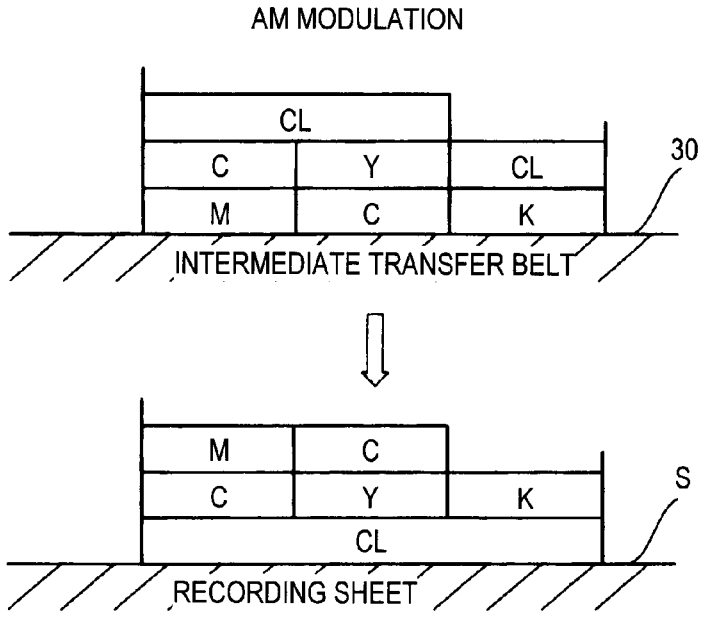
FIG. 4A is a diagram for explaining an image forming method based on an Amplitude Modulation.

A case where the image forming apparatus is based on an Amplitude Modulation will first be described. As shown in FIG. 4A, upon selection of the gloss mode, the color component toner images (M, C, Y, K) are transferred onto the intermediate transfer belt 30 in a superimposing manner by the image forming units 20 (20*a* to 20*d*). Thereafter, a gloss transparent toner image (CL) is layered on the respective color toner images by the gloss image forming unit 60. In a case illustrated, the gloss transparent toner image CL is formed on the whole or a part of the surface of the recording sheet S.

Thereafter, the superimposed images of the color component toner images (M, C, Y, K) and the gloss transparent toner image CL are simultaneously transferred from the intermediate transfer belt 30 onto the recording sheet S by the secondary transfer unit 35. The color component toner images (M, C, Y, K) on the recording sheet S are laminated on the recording sheet S with the gloss transparent toner image CL being interposed therebetween, and then fused and fixed by the fixing unit 40.

Through the image forming process, the color component toner images (M, C, Y, K) are formed on the gloss transparent toner images (CL). As a result, a glossy color image of high quality is obtained.

When the gloss mode is not selected, an image forming process is carried out by using only the normal image forming units 20 (20*a* to 20*d*), viz., not using the gloss image forming unit 60.

Figure 4B:
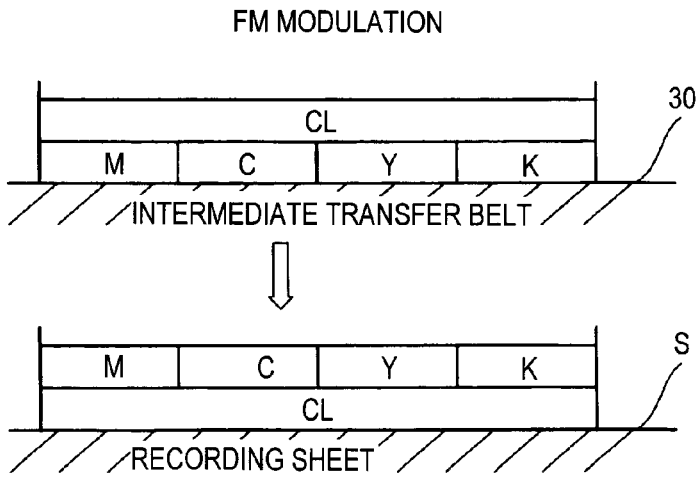
FIG. 4B is a diagram for explaining an image forming method based on an Frequency Modulation system.

Another case where the image forming apparatus is based on the Frequency Modulation will next be described. As shown in FIG. 4B, upon selection of the gloss mode, the image forming units 20 (20*a* to 20*d*) operate to transfer the color component toner images (M, C, Y, K) onto the intermediate transfer belt 30 in a non-superimposing fashion. Thereafter, the gloss image forming unit 60 operates to apply a gloss transparent toner image (CL) to over the color component toner images. In a case illustrated, the gloss transparent toner image CL is formed on the whole or a part of the surface of the recording sheet S.

Thereafter, the secondary transfer unit 35 operates to simultaneously transfer the color component toner images (M, C, Y, K) and the gloss transparent toner image CL from the intermediate transfer belt 30 onto the recording sheet S. The color component toner images (M, C, Y, K) on the recording sheet S are laminated on the recording sheet S with the gloss transparent toner image CL being interposed therebetween, and then fused and fixed by the fixing unit 40.

In the image forming apparatus based on the Frequency Modulation, the color component toner images (M, C, Y, K) are arrayed side by side. Therefore, the toner image layer formed is thinner than that in the Amplitude Modulation basis apparatus, and wasteful toner consumption is reduced.

Additionally, the Frequency Modulation basis apparatus does not need the full line screen, which is essentially used in the Amplitude Modulation basis apparatus. Accordingly, a chance of moire occurrence is lessened.

If required, both the Amplitude Modulation and the Frequency Modulation may be employed for one image formation.

In a specific example of such, the Amplitude Modulation or Frequency modulation is selected based on a predetermined criterion. For example, for a high density image area whose Macbeth image density is 1 or larger, the Frequency Modulation basis image forming process is selected.

In the embodiment, the color component toner images (M, C, Y, K) and the gloss transparent toner image CL, which are on the intermediate transfer belt 30, are brought into contact with the bending roll 50. In this connection, the bending roll 50 rotates following the movement of the intermediate transfer belt 30, and the transfer blocking bias voltage is applied to the bending roll 50. Accordingly, there is less chance that the color component toner images (M, C, Y, K) and the gloss transparent toner image CL are transferred from the intermediate transfer belt 30 onto the bending roll 50.

If urethane resin to which toner particles hardly attach is used for a surface protective layer of the bending roll 50, the amount of toner transferred is reduced.

The bending roll 50 supports the outside of the intermediate transfer belt 30. Therefore, if the bending roll 50 is disposed such that the bending roll 50 may swing about one end of the bending roll in an axial direction as swing fulcrum, the intermediate transfer belt 30 can be moved in meandering direction in accordance with a tilting of the bending roll 50. Thus, if the bending roll 50 is functioned also as a steering roll, the meandering control of the intermediate transfer belt 30 is possible.

Furthermore, it is noted that the gloss image forming unit 60 is located within the outside bending concave region 56 of the intermediate transfer belt 30. Accordingly, the space of the outside bending concave region 56 may effectively be utilized as the space in which the gloss image forming unit 60 is installed. Accordingly, the needless size increasing of the apparatus per se is effectively suppressed.

In the embodiment, the gloss image forming unit 60 is located between the tension roll 32 and the bending roll 50 in the outside bending concave region 56 of the intermediate transfer belt 30. If required, the gloss image forming unit 60 may be located between the tension roll 33 and the bending roll 50 in the outside bending concave region 56.

<Embodiment 2>

Figure 5:
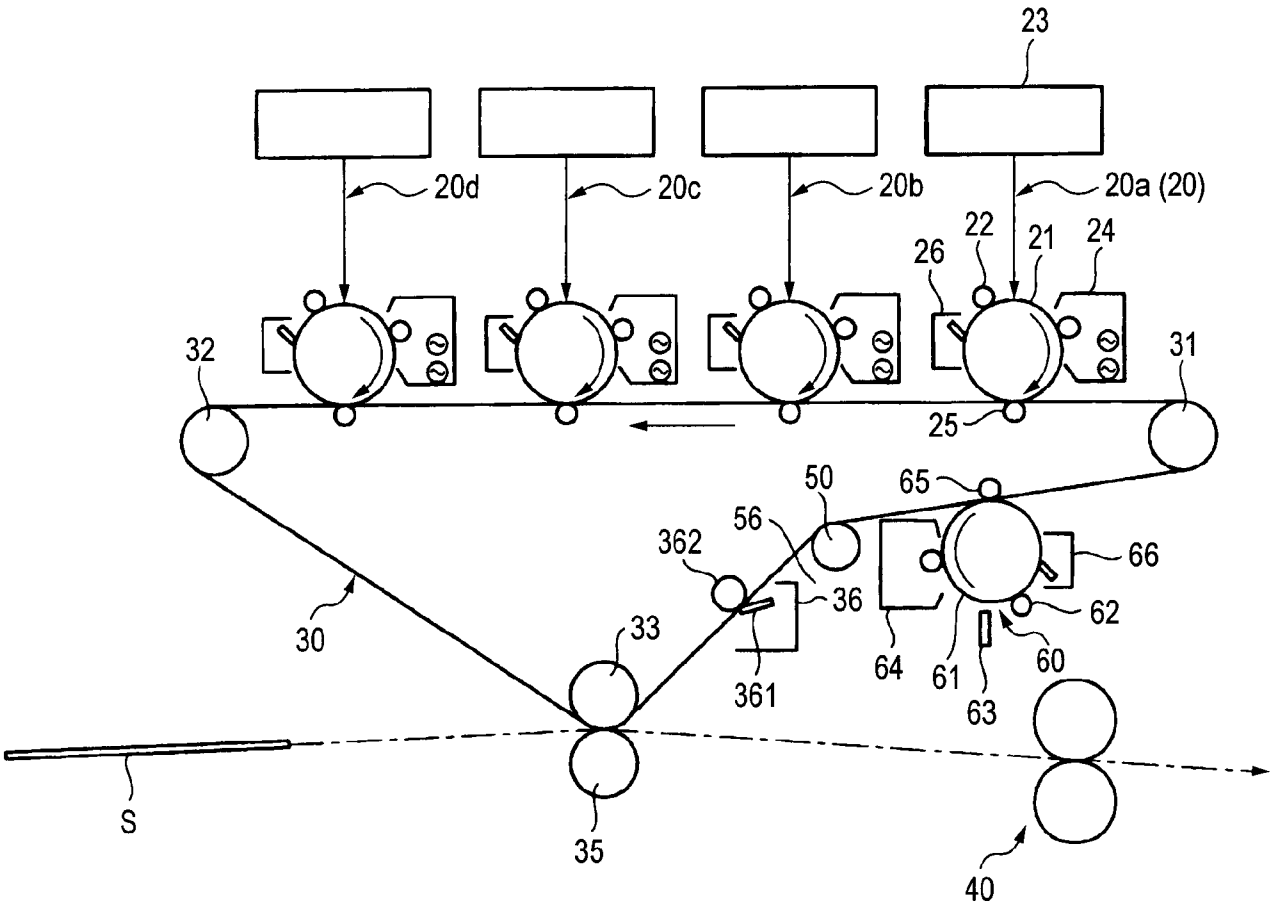
FIG. 5 is a diagram showing an embodiment 2 of an image forming apparatus incorporating the present invention thereinto.

FIG. 5 is a diagram showing an embodiment 2 of an image forming apparatus incorporating the present invention thereinto.

In the figure, a basic construction of the image forming apparatus is substantially the same as that of the embodiment 1. In the instant embodiment, unlike the embodiment 1, a rotatable bending roll 50 is located on the outside of the intermediate transfer belt 30, which is located between a pair of the adjacent tension rolls 31 and 33, in a state that it is in contact with the intermediate transfer belt. The bending roll 50 bends the intermediate transfer belt 30 toward the inside of a tangential line connecting points on the outer circumferences of the couple of tension rolls 32 and 33, whereby a outside bending concave region 56 is secured outside the intermediate transfer belt 30. In the figure, like or equivalent portions are designated by like reference numerals used in the embodiment 1, for simplicity of explanation, and hence no further description of them will be given.

In the embodiment, a gloss image forming unit 60 is located between the bending roll 50 and the tension roll 31 in the outside bending concave region 56 of the intermediate transfer belt 30. The gloss image forming unit 60 operates upon selection of the image forming mode.

A belt cleaning unit 36 is installed at a position between the tension roll 33 and the bending roll 50 in the outside bending concave region 56 of the intermediate transfer belt 30.

The belt cleaning unit 36 includes a blade 361, which will come in contact with the surface of the intermediate transfer belt 30, for example, and a back-up roll 362 located on the reverse side of the intermediate transfer belt 30 at a position corresponding to the blade 361.

In the embodiment, unlike the embodiment 1, the bending roll 50 is located within a portion where toner images, not yet fixed, do not pass. Further, the belt cleaning unit 36 is disposed upstream of the bending roll 50. Accordingly, there is less chance that the residual toner passes there. For this reason, there is no special limitation on the bending roll 50, when comparing with the embodiment 1.

Figure 6A:
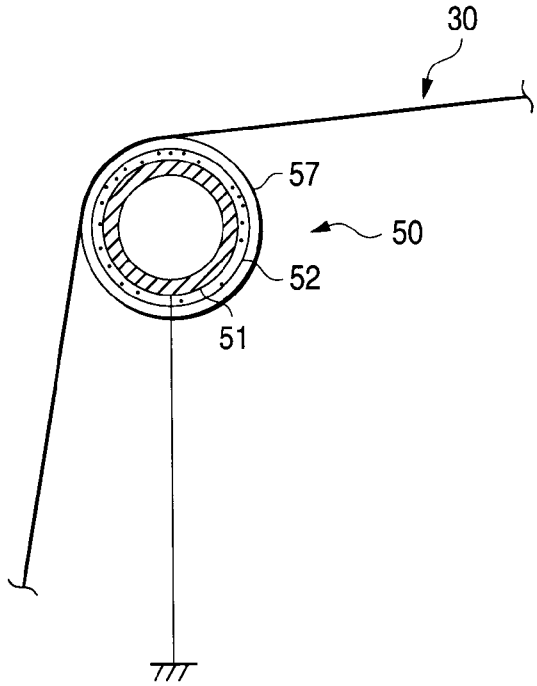
FIG. 6 is a diagram for explaining an arrangement of a bending roll used in the embodiment 2 of the invention.

Accordingly, in such a roll structure that, as shown in FIG. 6, a photosensitive layer 52 is formed over the surface of a metallic roll body 51, and the layer surface is covered with a protective layer 57, it is satisfactory to take such a measure that the roll body 51 is earthed to prevent charge from bring accumulated in the roll body.

Operations of the image forming apparatus of the embodiment will be described.

When the gloss mode is selected, contrary to the embodiment 1, the gloss image forming unit 60 operates to form a gloss transparent toner image CL on the intermediate transfer belt 30, and then the color component toner images (M, C, Y, K) are layered on the gloss transparent toner image CL by the image forming units 20 (20*a* to 20*d*) (for symbols, see FIG. 4).

Thereafter, the color component toner images (M, C, Y, K) and the gloss transparent toner image CL, which are superimposed on the intermediate transfer belt 30, are simultaneously transferred to a recording sheet S by the secondary transfer unit 35. As a result, the color component toner images (M, C, Y, K) are formed on the recording sheet S, and the gloss transparent toner image CL is layered on the toner images, and the resultant image is fused and fixed by the fixing unit 40.

Through the image forming process, the gloss transparent toner image CL is applied to the color component toner images (M, C, Y, K), whereby a glossy color image of high quality is formed.

Residual toner on the intermediate transfer belt 30 is removed by the belt cleaning unit 36. Accordingly, there is no chance of unnecessarily forming a stain on the bending roll 50.

Also in the embodiment, the gloss image forming unit 60 is located within the outside bending concave region 56 of the intermediate transfer belt 30. Accordingly, the size increasing of the apparatus per se is effectively avoided.

Figure 6B:
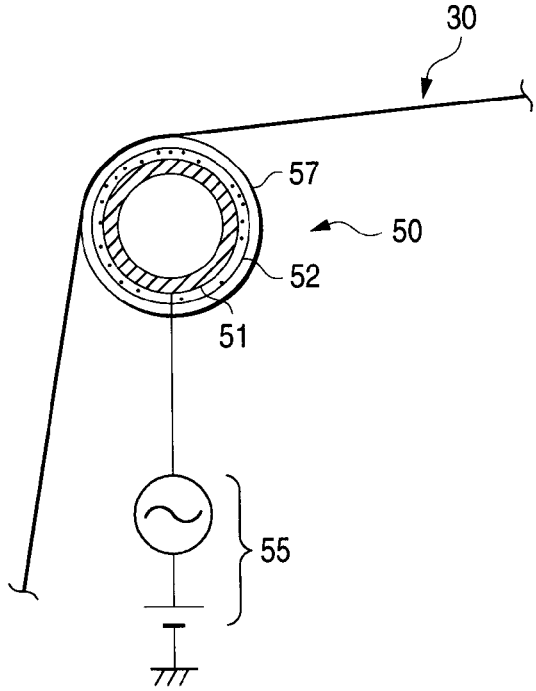

In an embodiment in which the cleaning units 26 and 66 of the image forming units 20 and 60 are utilized instead of the belt cleaning unit 36, residual toner passes the bending roll 50 part. Accordingly, a bias voltage supply 55 is coupled to the bending roll 50, as shown in FIG. 6B. The bias voltage supply applies a transfer blocking bias voltage having the same polarity (e.g., positive polarity) as that of the residual toner, for example, to the bending roll. To keep the transfer blocking effect good under the transfer blocking bias voltage, what one has to do is to additionally apply an AC bias voltage having a predetermined duty ratio to the bending roll.

Under the bias voltage applied, the residual toner passes the bending roll 50 portion with the movement of the intermediate transfer belt 30. At this time, the residual toner passes the transfer parts of the image forming units 20 and 60, while not being attracted to the bending roll 50.

When in the image forming units 20 and 60, a predetermined transfer voltage is applied to the related parts, the residual toner of the positive polarity is reversely transferred to the photoreceptor drums 21 and 61, and collected by the cleaning units 26 and 66.

<Embodiment 3>

Figure 7:
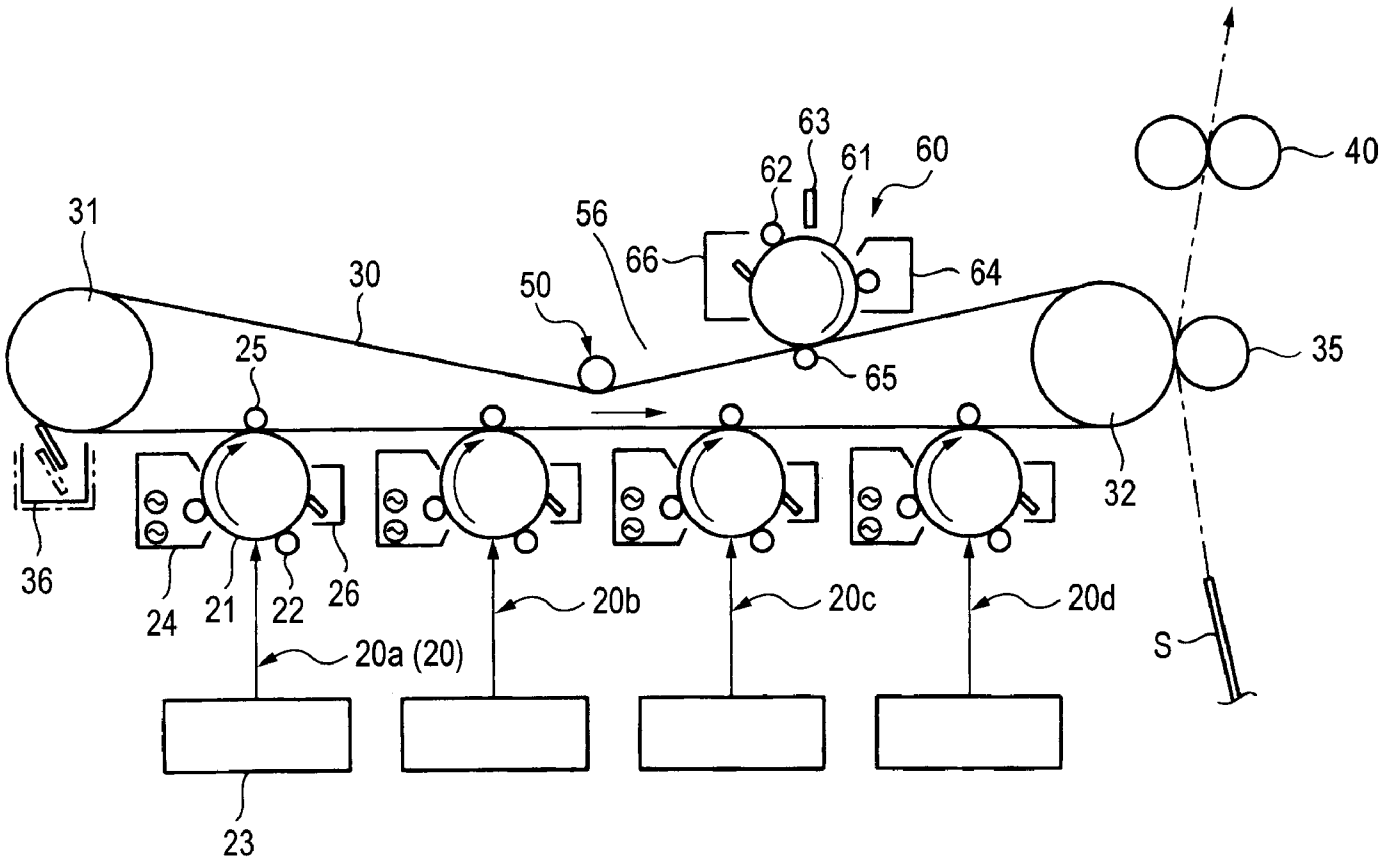
FIG. 7 is a diagram showing an embodiment 3 of an image forming apparatus incorporating the present invention thereinto.

FIG. 7 is a diagram showing an embodiment 3 of an image forming apparatus incorporating the present invention thereinto.

In the figure, a basic construction of the image forming apparatus is substantially the same as that of the embodiment 1. However, unlike the embodiment 1, the intermediate transfer belt 30 is wound around a pair of the tension rolls 31 and 32 of relatively large diameter. The normal image forming units 20 (20*a* to 20*d*) are disposed under the intermediate transfer belt 30. The bending roll 50 is located at the mid position in an upper part of the intermediate transfer belt. The outside bending concave region 56 is secured in an upper art of the intermediate transfer belt 30. The gloss image forming unit 60, for example, is located at a position between the bending roll 50 and the tension roll 32 in the outside bending concave region 56.

The belt cleaning unit 36 is retractively disposed at an upstream position of the most upstream normal image forming unit 20 (20*a*, in this instance), which is confronted with the tension roll 31.

Accordingly, in this embodiment, the belt cleaning unit 36 is kept in a retracting state, and a gloss transparent toner image CL is formed on the intermediate transfer belt 30 by the gloss image forming unit 60. Then, the color component toner images (M, C, Y, K) are formed on the gloss transparent toner image CL by the image forming units 20 (20*a* to 20*d*) (For symbols of the toner images, see FIG. 4).

Following this, the color component toner images (M, C, Y, K) and the gloss transparent toner image CL, which are superimposed one on another, are simultaneously transferred onto a recording sheet S by the secondary transfer unit 35. The color component toner images (M, C, Y, K) located on the recording sheet S, together with the gloss transparent toner image CL, are laminated and fused and fixed by the fixing unit 40.

In this way, a glossy color image of high quality is formed, as in the embodiments 1 and 2.

If the gloss image forming unit 60 is additionally installed near a part of the periphery of the intermediate transfer belt 30, the needlessly size increasing of the apparatus per se is effectively avoided.

<Embodiment 4>

Figure 8:
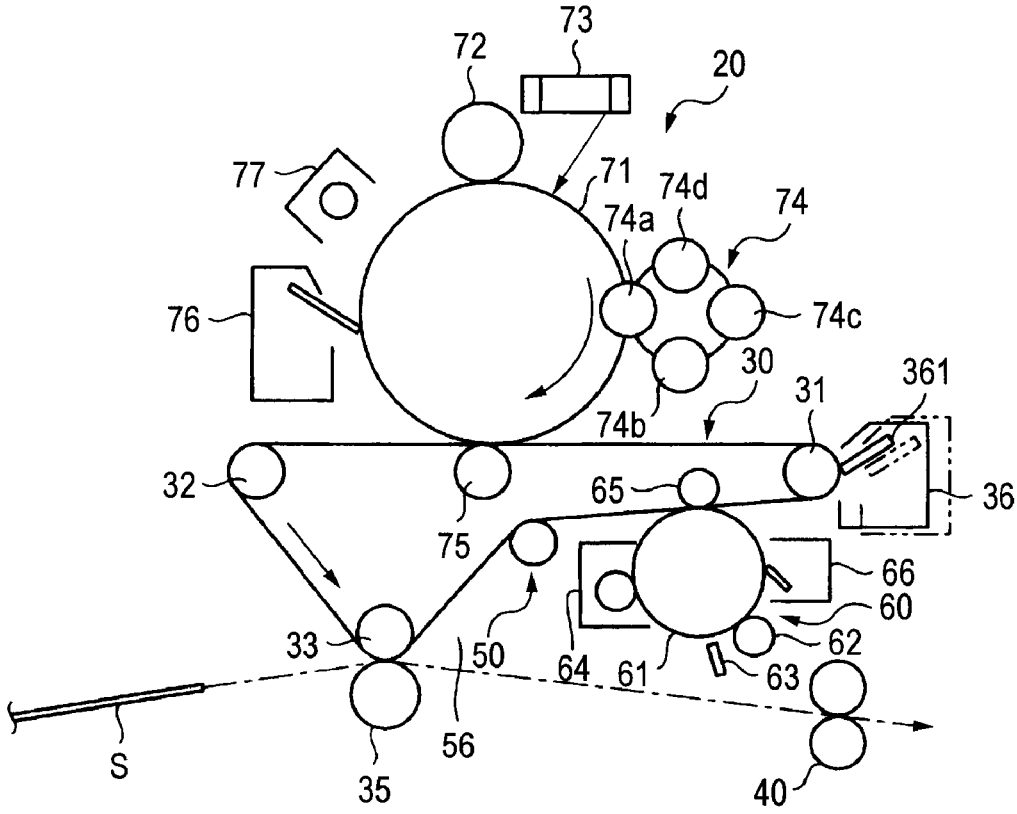
FIG. 8 is a diagram showing an embodiment 4 of an image forming apparatus incorporating the present invention thereinto.

FIG. 8 is a diagram showing an embodiment 4 of an image forming apparatus incorporating the present invention thereinto.

In the figure, unlike the embodiments 1 through 3, the image forming apparatus is an intermediate transfer type 4-cycle machine into which the present invention is incorporated. The image forming apparatus is made up of one normal image forming units 20, an intermediate transfer belt 30 disposed facing the normal image forming units 20, a gloss image forming unit 60 located within the outside bending concave region 56 provided at a part of the intermediate transfer belt 30, and simultaneous transfer unit (secondary transfer unit) 35 for simultaneously transferring the images from the intermediate transfer belt 30 onto the recording sheet S. In the figure, like or equivalent portions are designated by like reference numerals in the embodiment 1, for simplicity of explanation, and hence no further description of them will be given.

The image forming unit 20 includes a photoreceptor drum 71. Disposed around the photoreceptor drum 71 are a charging unit (e.g., charging roll) 72, an exposure unit 73 such as a laser scan unit, a rotary type developing unit 74 containing developing devices 74*a* to 74*d* which store color toners, a primary transfer unit (e.g., primary transfer roll) 75 for primarily transferring the image onto the intermediate transfer belt 30, a cleaning unit 76 for removing the residual toner for cleaning, and a charge remover (e.g., charge-removing lamp) 77 for removing the residual charge.

The intermediate transfer belt 30 is wound on a plurality of tension rolls 31 to 33, for example. The primary transfer unit 75 is located on the reverse side of the intermediate transfer belt 30 at a position thereon facing the photoreceptor drum 71. The secondary transfer unit 35 is disposed at a position on the intermediate transfer belt, which faces the tension roll 33. The belt cleaning unit 36 is retractively disposed at a position on the intermediate transfer belt, which faces the tension roll 31.

The bending roll 50 is disposed outside the intermediate transfer belt 30 at a position on the transfer belt, which is located between the tension rolls 31 and 33, to thereby secure a outside bending concave region 56. The gloss image forming unit 60, which operates when gloss mode is selected, is located at a position in the outside bending concave region 56, which is located between the bending roll 50 and the tension roll 31.

Accordingly, in the embodiment, when gloss mode is selected, the belt cleaning unit 36 is put in a retracting state. The color component toner images (M, C, Y, K) are successively formed on the photoreceptor drum 71 by the image forming unit 20. Those images are primarily transferred onto the intermediate transfer belt 30 in successive order. The gloss image forming unit 60 is operated at a desired timing to form a gloss transparent toner image CL on the intermediate transfer belt 30 (for symbols of the toner images, see FIG. 4).

Subsequently, the color component toner images (M, C, Y, K) and the gloss transparent toner image CL, which are transferred and superimposed, are simultaneously transferred from the intermediate transfer belt 30 to a recording sheet S by the secondary transfer unit 35. The color component toner images (M, C, Y, K), together with the gloss transparent toner image CL, are laminated on the recording sheet S, and fused and fixed by the fixing unit 40.

Also in the embodiment, a glossy color image of high quality is formed while not being accompanied by the increase of the apparatus size, as in the embodiment 1 and other embodiments.

<Embodiment 5>

Figure 9:
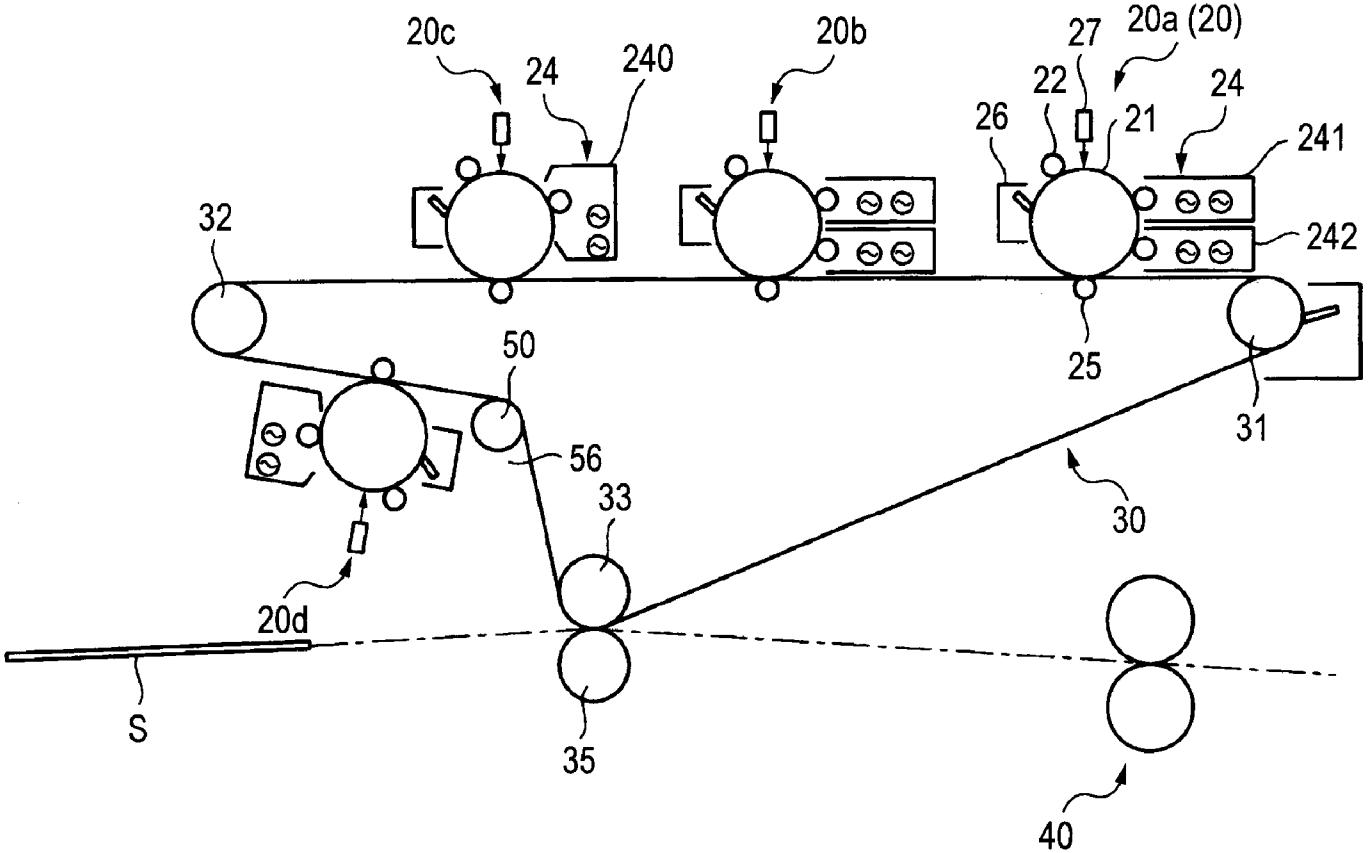
FIG. 9 is a diagram showing an embodiment 5 of an image forming apparatus incorporating the present invention thereinto.

FIG. 9 is a diagram showing an embodiment 5 of an image forming apparatus to which the present invention is applied.

In the figure, the image forming apparatus is an intermediate transfer type tandem machine, as in the embodiment 1 and other embodiments. The instant embodiment handles six color component toners by using four image forming units 20 (20*a* to 20*d*), whereby it is operable in the gloss mode, unlike the embodiment 1 and other embodiments.

In the embodiment, the image forming units 20*a* and 20*b* are each arranged so as to selectively use one of two color toners. For example, the image forming unit 20*a* uses selectively one of two color toners of gloss magenta M1 and normal magenta M2. The image forming unit 20*b* uses selectively one of two color toners of gloss cyan C1 and normal cyan C2.

The image forming units 20*c* and 20*d* are each designed to use one color toner. For example, the image forming unit 20*c* uses a color toner of yellow Y, and the image forming unit 20*d* uses a color toner of black K.

The basic arrangement of each image forming unit 20 (20*a* to 20*d*) is substantially the same as of the embodiment 1 or the like. Specifically, a charging unit (e.g., charging roll) 22, exposure unit (e.g., LED array) 27, developing unit 24, primary transfer unit (primary transfer roll) 25, and a cleaning unit 26 are disposed around the photoreceptor drum 21.

The image forming units 20*a* and 20*b* are different from the image forming units 20*c* and 20*d* in the construction of their developing units 24.

Figure 10A:
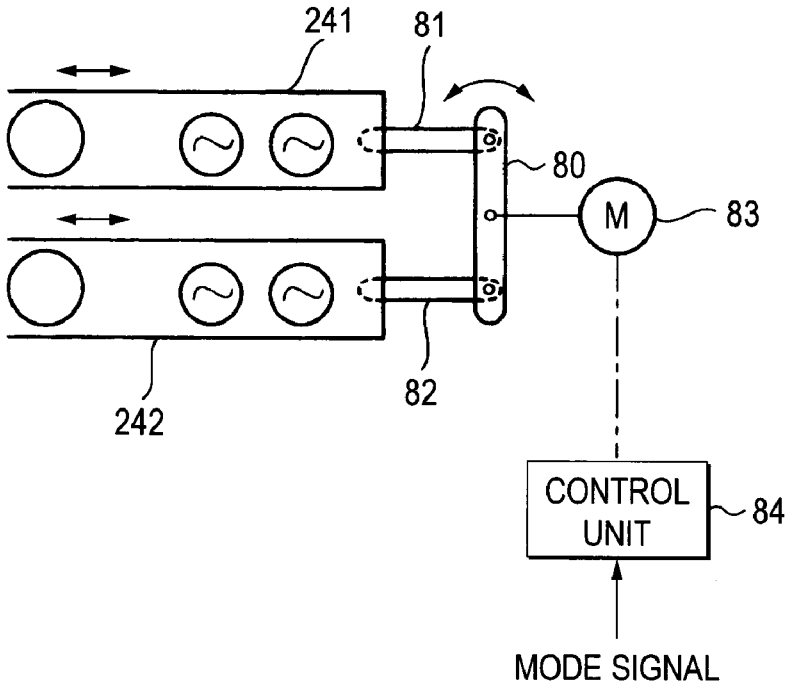
FIG. 10A is a diagram for explaining a select mechanism in an embodiment in which of the image forming units used in the embodiment 5, some of the image forming units are each provided with a plurality of developing units, and either of the developing units is selected by a select mechanism.

Specifically, as shown in FIG. 10A, in each of the image forming units 20*a* and 20*b*, the developing unit 24 includes two developing devices 241 and 242 respectively storing color toners of gloss magenta M1 (or cyan C1) and normal magenta M2 (or cyan C2). Either of the developing devices 241 and 242 is selected by a select mechanism.

An example of the select mechanism is shown in FIG. 10A. As shown, the developing devices 241 and 242 are provided to be able to move forward and backward in relation to the photoreceptor drum 21. A select arm 80, which may be turned, is provided on the rear side of the developing devices 241 and 242. Both ends of the select arm 80 are coupled to the developing devices 241 and 242 by coupling arms 81 and 82, respectively. The select arm 80 is turned in a desired direction by a select motor 83.

The select motor 83 is rotated in a desired direction in accordance with control signals derived from a control unit 84, for example. When a mode signal of "gloss mode select" (gloss present mode), is input to the control unit 84, the select motor 83 rotates and turns the select arm 80 counterclockwise, as shown in FIG. 10A. As a result, the developing device 241 containing the color toner of gloss magenta M1 (or gloss cyan C1) is selected. When a mode signal of "gloss absent mode select" is input to the control unit 84, the select motor 83 rotates and turns the select arm 80 clockwise, as shown in FIG. 10A. As a result, the developing device 242 containing the color toner of normal magenta M2 (or normal cyan C2) is selected.

In each of the image forming units 20*c* and 20*d*, the developing unit 24 includes a single developing device 240, but a select mechanism as described above.

In the embodiment, the developing unit 24 of each of the image forming units 20*a* and 20*b* contains two developing devices 241 and 242, and those developing devices are vertically arranged. Therefore, to secure the housing volume of each developing device for storing a satisfactory amount of developer, the housing of the developing device must be configured to be elongated horizontally.

For this reason, the image forming units 20*a* and 20*b* are configured to have larger horizontal dimensions than those of the remaining image forming units 20*c* and 20*d*.

Therefore, in this embodiment, the intermediate transfer belt 30 is wound on the three tension rolls 31 to 33, and a flat part, while horizontally extending, is present between the tension rolls 31 and 32. A bending roll 50 is located at a position between the tension rolls 32 and 33 to secure an outside bending concave region 56 therearound.

Three image forming units 20*a* to 20*c* are located at the horizontal part of the intermediate transfer belt 30, which extends between the tension rolls 31 and 32. An image forming unit 20*d* is located in the outside bending concave region 56.

In the figure, like or equivalent portions are designated by like reference numerals used in the embodiment 1 and the like, for simplicity of explanation, and hence no further description of them will be given.

Accordingly, in the embodiment, in the image forming units 20*a* and 20*b*, when the gloss mode (gloss present mode) is selected, the developing device 241 containing the color toner of gloss magenta M1 or gloss cyan C1 of the developing unit 24 is selected.

Accordingly, color toner images of gloss magenta M1, gloss cyan C1, yellow Y, black K are formed by the image forming units 20 (20*a* to 20*d*), and are transferred onto the recording sheet S with the aid of the intermediate transfer belt 30, and then fused and fixed by the fixing unit 40.

Figure 10B:
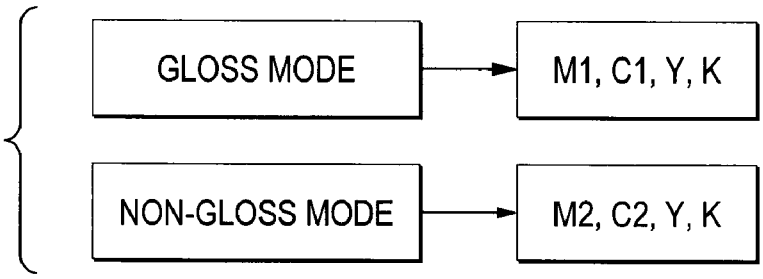
FIG. 10B is a diagram showing in model form image forming processes defined by image forming modes.

Therefore, as shown in FIG. 10B, a glossy color image of high quality, which is composed of color component toners (M1, C1, Y, K), is produced when the gloss mode (gloss present mode) is selected.

In the gloss absent mode, the developing device 242 containing the color toner of normal magenta M2 or normal cyan C2 of the developing unit 24 is selected in the image forming units 20*a* and 20*b*.

Accordingly, color toner images of normal magenta M2, normal cyan C2, yellow Y, black K are formed by the image forming units 20 (20*a* to 20*d*), and are transferred onto the recording sheet S with the aid of the intermediate transfer belt 30, and then fused and fixed by the fixing unit 40.

Therefore, as shown in FIG. 10B, in the gloss absent mode, a non-gloss color image of high quality, which is composed of color component toners (M2, C2, Y, K), is produced.

In the embodiment, the image forming unit 20*d* is installed by utilizing a space of the outside bending concave region 56 of the intermediate transfer belt 30. Accordingly, the length of the horizontal part of the intermediate transfer belt 30 is smaller than that in the case where the image forming units 20*a* to 20*d* are arranged side by side. Further, there is no need of securing a space for installing the image forming units 20 under the intermediate transfer belt 30.

Thus, in the embodiment, a glossy color image of high quality is produced while not being accompanied by the size increase of the apparatus per se.

<Embodiment 6>

Figure 11:
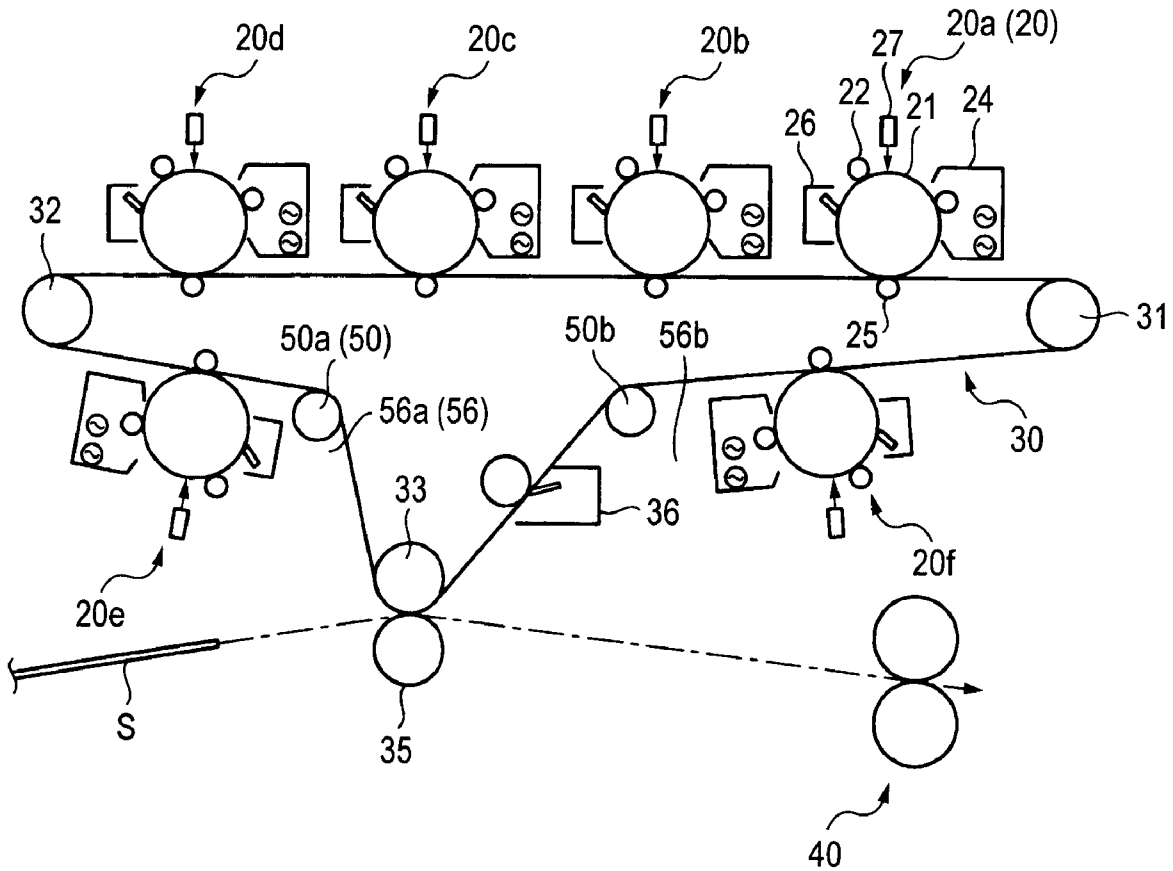
FIG. 11 is a diagram showing an embodiment 6 of an image forming apparatus incorporating the present invention thereinto.

FIG. 11 is a diagram showing an embodiment 6 of an image forming apparatus incorporating the present invention thereinto.

In the figure, the instant image forming apparatus handles six color component toners as in the embodiment 5, and hence it is operable in the gloss mode. The instant embodiment handles color component toners of six colors by using six normal image forming units 20 (20*a* to 20*f*), and hence is operable in the gloss mode.

In the present embodiment, the image forming units 20 (20*a* to 20*f*) handle the color toners of six colors, gloss magenta M1, normal magenta M2, gloss cyan C1, normal cyan C2, yellow Y, and black K. Those image forming units are operated in an appropriate order, for example, 20*f*→20*a*→20*b*→20*c*→20*d*→20*e*, to form color toner images.

Particularly, in this embodiment, the intermediate transfer belt 30 is wound on the three tension rolls 31 to 33, and a bending roll 50*a* is located outside a part of the intermediate transfer belt between the tension rolls 32 and 33, thereby securing an outside bending concave region 56*a*. A bending roll 50*b* is located outside apart of the intermediate transfer belt between the tension rolls 32 and 31, thereby securing an outside bending concave region 56*b*.

Four normal image forming units 20*a* to 20*d* are located side by side at positions corresponding to a flat part of the intermediate transfer belt 30 which extends between the tension rolls 31 and 32. The normal image forming units 20*e* and 20*f* are respectively installed in the outside bending concave regions 56*a* and 56*b*.

In the figure, like or equivalent portions are designated by like reference numerals used in the embodiment 1 and the like, for simplicity of explanation, and hence no further description of them will be given.

In the instant embodiment thus constructed, when a gloss mode (gloss present mode), for example, is selected, the normal image forming units 20*f*, 20*b*, 20*d* and 20*e*, for example, are selected, and the color toner images of gloss magenta M1, gloss cyan C1, yellow Y and black K are formed. Those color toner images are transferred to a recording sheet S with the aid of the intermediate transfer belt 30, and then are fused and fixed by the fixing unit 40.

Therefore, as shown in FIG. 10B, a glossy color image of high quality, which is composed of color component toners (M1, C1, Y, K), is produced when the gloss mode (gloss present mode) is selected.

In the gloss absent mode, the normal image forming units 20*a*, 20*c*, 20*d* and 20*e* are selected and color toner images of normal magenta M2, normal cyan C2, yellow Y and black K are formed, and those color toner images are transferred to a recording sheet S with the aid of the intermediate transfer belt 30, and then are fused and fixed by the fixing unit 40.

Therefore, as shown in FIG. 10B, a non-gloss color image, which is composed of color component toners (M2, C2, Y, K), is produced when the gloss absent mode is selected.

In the embodiment, the image forming units 20*e* and 20*f* are installed by utilizing the spaces of the outside bending concave regions 56*a* and 56*b* of the intermediate transfer belt 30. Accordingly, the length of the horizontal part of the intermediate transfer belt 30 is smaller than that in the case where the image forming units 20*a* to 20*f* are arranged side by side. Further, there is no need of securing a space for installing the image forming units 20 under the intermediate transfer belt 30.

Thus, in the embodiment, a glossy color image of high quality is produced while not being accompanied by the size increase of the apparatus per se.

<Embodiment 7>

Figure 12:
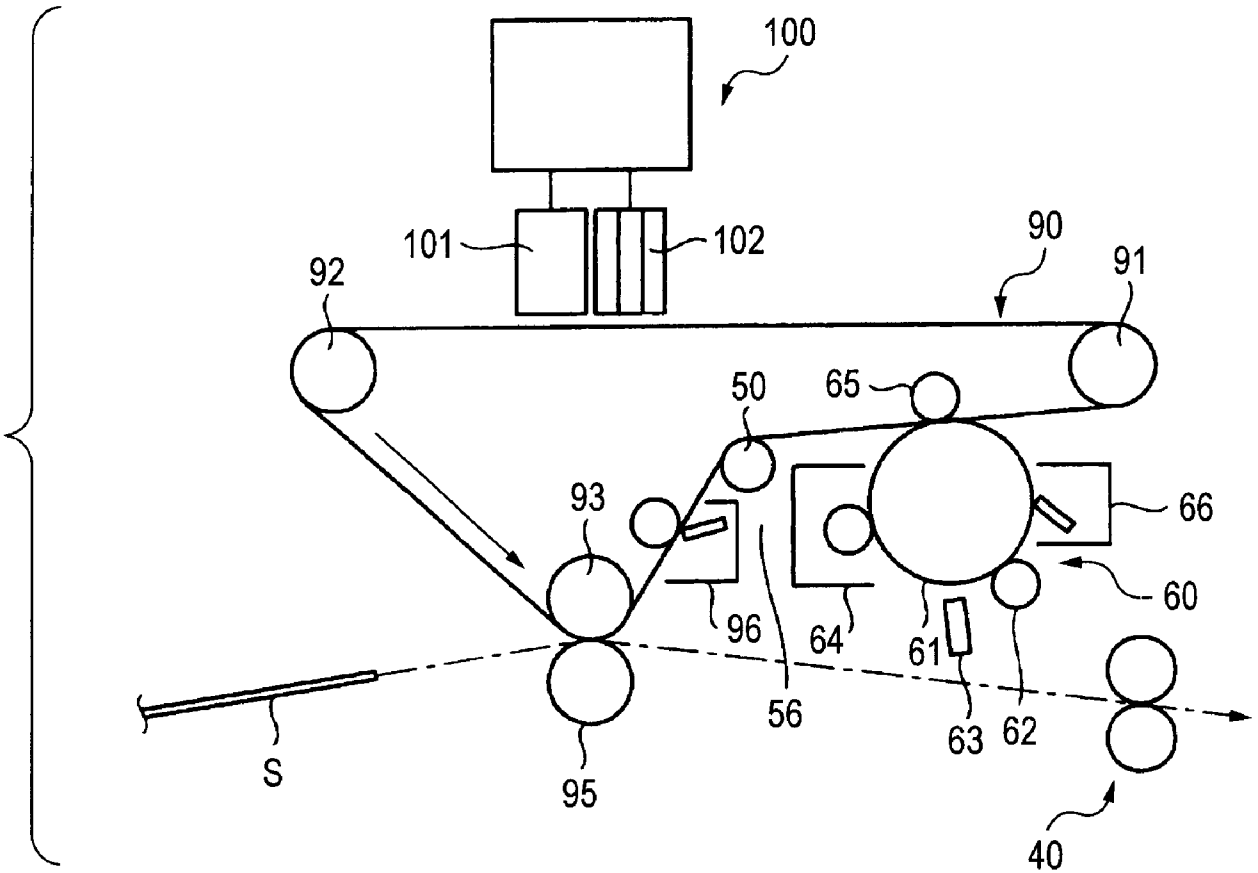
FIG. 12 is a diagram showing an embodiment 7 of an image forming apparatus incorporating the present invention thereinto.

FIG. 12 is a diagram showing an embodiment 7 of an image forming apparatus to which the present invention is applied.

In the figure, the image forming apparatus, unlike the embodiments 1 to 6, has an ink jet image forming unit 100, an image transporting belt 90 for transporting color ink images formed by the ink jet image forming unit 100, a gloss image forming unit 60 for forming a gloss transparent toner image on the image transporting belt 90, a transfer unit 95 for transferring the ink images and the gloss transparent toner image from the image transporting belt 90 to a recording sheet S, and a fixing unit 40 for fusing and fixing a toner image, not yet fixed, on the recording sheet S.

In the figure, like or equivalent portions are designated by like reference numerals used in the embodiment 1 and the like, for simplicity of explanation, and hence no further description of them will be given.

Figure 13A:
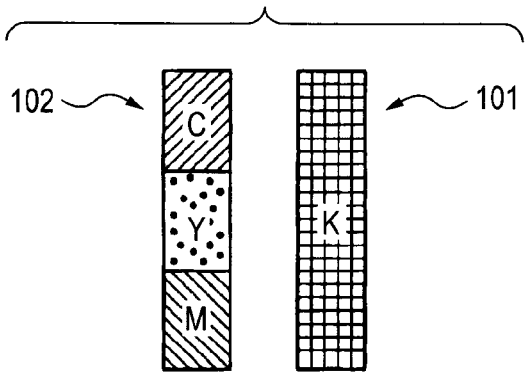
FIG. 13A is a diagram for explaining a recording head of an ink jet image-forming unit as one form of an image forming unit.

In the instant embodiment, the ink jet image forming unit 100, as shown in FIGS. 12 and 13A, includes a black recording head 101 having a black ink cartridge mounted thereon, and color recording heads 102 having three color cartridges of cyan (C) yellow (Y) and magenta (M), which are mounted thereon. The color areas of the color recording heads 102 may appropriately be arrayed. If necessary, the color recording head may be provided for each color.

The material of the image transporting belt 90 may be any material if it is capable of holding the gloss transparent toner image and the ink images thereon (a belt material of polyimide resin, for example). The image transporting belt 90 is wound around three tension rolls 91 to 93 in a circulating fashion, and a tension roll 91 is used as a drive roll.

A transfer unit (transfer roll in this instance) 95 is located at a part of the image transporting belt 90, which corresponds in position to the tension roll 93, and a tension roll 93 is used as a backup roll.

In the embodiment, a bending roll 50 is located at an outside part of the image transporting belt 90, which is located between tension rolls 91 and 93, and an outside bending concave region 56 is formed under the image transporting belt 90.

A gloss image forming unit 60 is located at a position within the outside bending concave region 56, which is located between the bending roll 50 and the tension roll 91. A belt cleaning unit 96 is located at a position within the outside bending concave region 56, which is located between the tension roll 93 and the bending roll 50.

The gloss image forming unit 60 operates upon selection of the gloss mode (gloss present mode).

Accordingly, in the instant embodiment, upon selection of the gloss mode (gloss present mode), the gloss image forming unit 60 first operates, a gloss transparent toner image is formed in a given area (area previously designated) on the image transporting belt 90, and then color ink images are formed by the ink jet image forming unit 100.

Figure 13B:
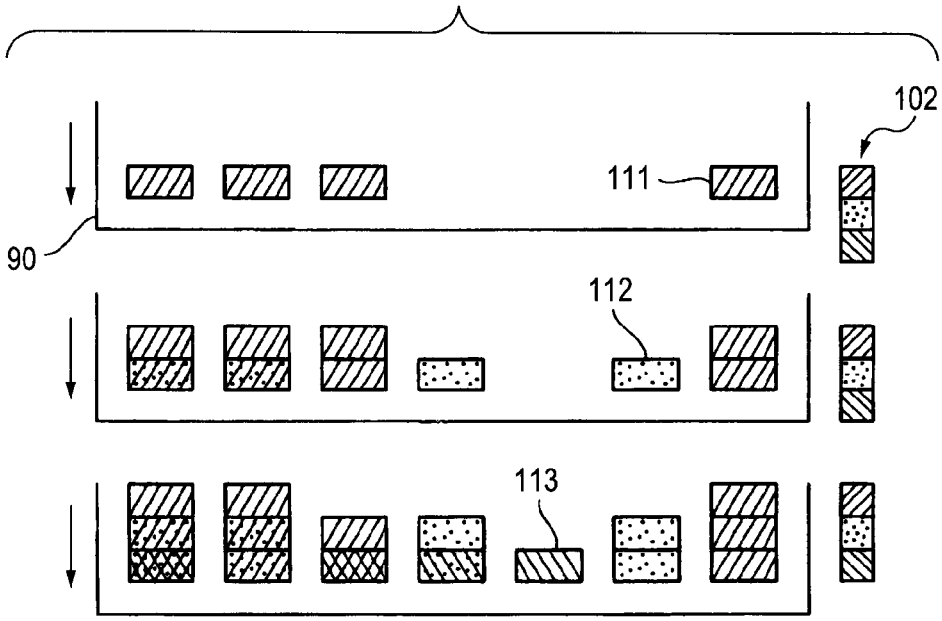
FIG. 13B is a diagram showing in model form an image forming process carried out by a color recording head.
Figure 13C:
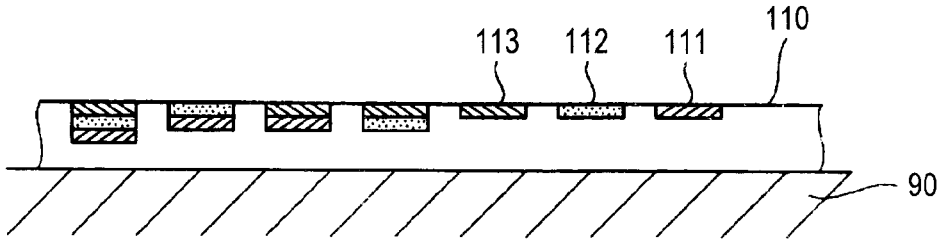
FIG. 13C is a diagram showing an image formation on an image transporting belt.

A model of the image forming process carried out by the color recording heads 102, for example, is diagrammatically presented. As shown in FIG. 13B, the color recording heads 102 perform printing for each color area to form color images of seven colors, cyan, yellow, magenta, green (cyan+yellow), blue (cyan+magenta), red (magenta+yellow), black (cyan+yellow+magenta). In the embodiment, the black recording head 101 is used. Accordingly, the black image is formed mainly by the black recording head 101.

Particularly, in the instant embodiment, the color ink images (111=cyan image, 112=yellow ink image, 113=magenta ink image) are formed on a gloss transparent toner image 110. Therefore, the color ink images 111 to 113 penetrate into the gloss transparent toner image 110, and there is no chance that the height of the image is excessively high.

Thereafter, the gloss transparent toner image 110 and the color ink images 111 to 113, which are superimposed, are simultaneously transferred from the image transporting belt 90 onto a recording sheet S by the transfer unit 95. The color ink images (111 to 113), together with the gloss transparent toner image 110, are fused and fixed on the recording sheet S by the fixing unit 40.

The color ink images 111 to 113 are formed on the gloss transparent toner image 110 through the image forming process. Accordingly, a glossy color image of high quality is produced. When the gloss mode is not selected, the image forming process is carried out by using only the ink jet image forming unit 100, while the gloss image forming unit 60 is put in no use state.

As seen from the foregoing description, an outside bending concave region is provided at a part of a belt transfer member, and an image forming unit may be additionally installed within the outside bending concave region. Accordingly, a recess space of the outside bending concave region of the belt transfer member is effectively utilized, and the image forming unit for improving the color reproducibility may be additionally installed without its excessive projection out of the apparatus body.

For this reason, the image forming apparatus makes more improvement of the color reproducibility of a reproduced image while effectively suppressing the size increase of the whole image forming apparatus.

What is claimed is:

1. An image forming apparatus comprising:

at least one image forming unit;

a belt transferring member;

a plurality of tension rolls; and a bending member, wherein the image forming unit forms a visual image on the belt transferring member to transfer the visual image onto a recording medium through the belt transferring member;

wherein the belt transferring member has an endless belt wound on the tension rolls;

wherein the bending member is disposed in outside of the endless belt between at least a pair of tension rolls to bend the endless belt toward inside of a tangential line connected between an outer peripheral ends of at least the pair of adjacent tension rolls;

wherein the tangential line and the endless belt define an outer bending concave region; and wherein an additional image forming unit is disposed at least partially in the outer bending concave region.

2. The image forming apparatus according to claim 1, wherein the bending member is a rotary body.

3. The image forming apparatus according to claim 1, wherein a transfer blocking bias voltage for preventing transferring mainly of at least one of the visual image and a residual visual image on the belt transfer member to the bending member is applied to the bending member.

4. The image forming apparatus according to claim 1, wherein the bending member is electrically earthed.

5. The image forming apparatus according to claim 1, wherein the additional image forming unit and the image forming units are of the same type.

6. The image forming apparatus according to claim 1, wherein the additional image forming unit and the image forming units include at least two types different from each other.

7. The image forming apparatus according to claim 6, wherein at least one of the additional image forming unit and the image forming units forms a transparent layer.

8. The image forming apparatus according to claim 6, wherein at least one of the additional image forming unit and the image forming units selects one of an glossy colorant and a non-glossy colorant in relation to at least one color component.

9. The image forming apparatus according to claim 6, wherein at least one of the additional image forming unit and the image forming units forms a transparent layer to laminate the transparent layer corresponding to a surface of the recording medium; and wherein the remaining image forming units use ink colorant to be impregnated into the transparent layer.

10. The image forming apparatus according to claim 6, wherein the additional image forming unit and the plurality of image forming units have color component colorants for forming color images; and wherein the additional image forming unit and the image forming units arrange the color component colorants in non-superimposing fashion.

11. The image forming apparatus according to claim 6, wherein the additional image forming unit and the image forming units include an ink jet image forming unit.

12. The image forming apparatus according to claim 1, wherein the additional image forming unit is a glossy image forming unit; and wherein the glossy image forming unit is disposed on a side where the glossy image forming unit is opposed to the image forming unit through the belt transfer member.

13. An image forming apparatus according to claim 1, wherein the additional image forming unit is a glossy image forming unit; and wherein the glossy image forming unit is disposed downstream of the image forming unit.

14. The image forming apparatus according to claim 13, wherein the image forming unit for forming the full color image is capable of forming color images of a least Y, M and C colors.

15. The image forming apparatus according to claim 13, further comprising at least two developing units having orange and green, respectively.

16. An image forming apparatus comprising:

at least one image forming unit;

a belt transferring member;

a plurality of tension rolls; and a bending member, wherein the image forming unit forms a visual image on the belt transferring member to transfer the visual image onto a recording medium through the belt transferring member;

wherein the belt transferring member has an endless belt wound on the tension rolls;

wherein the bending member is disposed in outside of the endless belt between at least a pair of tension rolls to bend the endless belt toward inside of a tangential line connected between an outer peripheral ends of at least the pair of adjacent tension rolls;

wherein the tangential line and the endless belt define an outer bending concave region;

wherein it is possible to dispose an additional image forming unit in the outer bending concave region at least partially; and wherein the bending member is disposed at a place where the visual image carried on the belt transfer member is nipped.

17. An image forming apparatus comprising:

at least one image forming unit;

a belt transferring member;

a plurality of tension rolls; and a bending member, wherein the image forming unit forms a visual image on the belt transferring member to transfer the visual image onto a recording medium through the belt transferring member;

wherein the belt transferring member has an endless belt wound on the tension rolls;

wherein the bending member is disposed in outside of the endless belt between at least a pair of tension rolls to bend the endless belt toward inside of a tangential line connected between an outer peripheral ends of at least the pair of adjacent tension rolls;

wherein the tangential line and the endless belt define an outer bending concave region;

wherein it is possible to dispose an additional image forming unit in the outer bending concave region at least partially; and wherein the bending member has a surface protective layer for preventing transferring mainly of at least one of the visual image and a residual visual image on the belt transfer member to the bending member.

18. An image forming apparatus comprising:

at least one image forming unit;

a belt transferring member;

a plurality of tension rolls; and a bending member, wherein the image forming unit forms a visual image on the belt transferring member to transfer the visual image onto a recording medium through the belt transferring member;

wherein the belt transferring member has an endless belt wound on the tension rolls;

wherein the bending member is disposed in outside of the endless belt between at least a pair of tension rolls to bend the endless belt toward inside of a tangential line connected between an outer peripheral ends of at least the pair of adjacent tension rolls;

wherein the tangential line and the endless belt define an outer bending concave region;

wherein it is possible to dispose an additional image forming unit in the outer bending concave region at least partially; and wherein the bending member is a photoreceptor including a surface having a photoconductive and photosensitive layer.

19. An image forming apparatus comprising:

at least one image forming unit;

a belt transferring member;

a plurality of tension rolls; and a bending member, wherein the image forming unit forms a visual image on the belt transferring member to transfer the visual image onto a recording medium through the belt transferring member;

wherein the belt transferring member has an endless belt wound on the tension rolls;

wherein the bending member is disposed in outside of the endless belt between at least a pair of tension rolls to bend the endless belt toward inside of a tangential line connected between an outer peripheral ends of at least the pair of adjacent tension rolls;

wherein the tangential line and the endless belt define an outer bending concave region;

wherein it is possible to dispose an additional image forming unit in the outer bending concave region at least partially; and wherein the bending member is detachable from the belt transfer member.

20. An image forming apparatus comprising:

at least one image forming unit;

a belt transferring member;

a plurality of tension rolls; and a bending member, wherein the image forming unit forms a visual image on the belt transferring member to transfer the visual image onto a recording medium through the belt transferring member;

wherein the belt transferring member has an endless belt wound on the tension rolls;

wherein the bending member is disposed in outside of the endless belt between at least a pair of tension rolls to bend the endless belt toward inside of a tangential line connected between an outer peripheral ends of at least the pair of adjacent tension rolls;

wherein the tangential line and the endless belt define an outer bending concave region;

wherein it is possible to dispose an additional image forming unit in the outer bending concave region at least partially; and wherein the bending member serves as a steering member for controlling a meandering motion of the belt transfer member.

21. A belt module comprising:

at least one image forming unit for forming a visual image on the belt transferring member;

a belt transferring member;

a plurality of tension rolls; and a bending member, wherein the belt transferring member has an endless belt wound on the tension rolls;

wherein the bending member is disposed in outside of the endless belt between at least a pair of tension rolls to bend the endless belt toward inside of a tangential line connected between an outer peripheral ends of at least the pair of adjacent tension rolls;

wherein the tangential line and the endless belt define an outer bending concave region; and wherein the image forming unit is disposed in the outer bending concave region.

* * * * *